United States Patent [19]

Skaalen

[11] 4,276,958

[45] Jul. 7, 1981

[54] PERSONNEL CHAIN CLIMBER

[75] Inventor: Clifford I. Skaalen, Oxnard, Calif.

[73] Assignee: The United States of America as represented by the Secretary of the Navy, Washington, D.C.

[21] Appl. No.: 142,281

[22] Filed: Apr. 21, 1980

[51] Int. Cl.[3] ..... A63B 27/00

[52] U.S. Cl. ..... 182/135; 182/191; 182/221

[58] Field of Search ..... 182/133, 134, 135, 136, 182/190, 189, 100, 221, 191

[56] References Cited

U.S. PATENT DOCUMENTS

| | | | |
|---|---|---|---|
| 580,794 | 4/1897 | Money | 182/135 |
| 952,720 | 3/1910 | Allen | 182/135 |
| 1,168,321 | 1/1916 | Maley | 182/135 |
| 1,307,468 | 6/1919 | Wells | 182/135 |
| 1,751,131 | 3/1930 | Costello | 182/136 |
| 1,964,995 | 7/1934 | McLaughlin | 182/136 |
| 1,982,482 | 11/1934 | Rhodes | 182/133 |
| 2,057,013 | 10/1936 | Curtis | 182/134 |
| 3,075,611 | 1/1963 | Baringer | 182/134 |
| 3,938,620 | 2/1976 | Nothiger | 182/135 |
| 3,968,858 | 7/1976 | Vollan | 182/135 |

*Primary Examiner*—Reinaldo P. Machado

*Attorney, Agent, or Firm*—Richard S. Sciascia; Joseph M. St.Amand; William C. Daubenspeck

[57] ABSTRACT

Apparatus for use as a chain climbing device or a chain racheting device includes a pair of spring-closed opposing cams disposed in a rigid structure which supports a pair of cam pins, each of which extends through an elongated aperture in one of the cams. The weight of a person using the chain climbing device is transferred from a pair of cam stops attached to the rigid structure to the cams to the chain. When the device is used for chain racheting the weight of the chain is transferred to the cams to the cam stops to the rigid structure. The shape of the cams and the elongated apertures enable the cams to rotate about and slide upward or downward on the cam pins to selectively allow upward or downward relative motion between the chain and the apparatus or lock the chain and the apparatus in a fixed relationship.

11 Claims, 9 Drawing Figures

PERSONNEL CHAIN CLIMBER

BACKGROUND OF THE INVENTION

This invention relates in general to climbing devices and in particular to a device for use in ascending or descending a chain.

Chains are used in some modern construction techniques and in some situations there is a requirement that the chains be ascended or descended by the construction personnel. For example, the Navy Elevated Causeway System incorporates hydraulic chain jacks mounted on top of driven pipe pile. The lift chain passes through the chain jack and is attached to the causeway being lifted. During intitial lifting stages the top of the jack is sometimes 35 to 40 feet above the causeway deck. Because jacks may require adjustment during the lifting process, it is necessary for personnel to reach the top of the chain jack. Unaided climbing is both difficult and dangerous on the slippery and cumbersome chains.

The art of scaling or climbing devices contains numerous devices for ascending or descending poles or ropes. However, the rope climbing devices and pole climbing devices are not suitable for use with chains. Accordingly, there is a need for a simple, safe device for ascending or descending chains.

SUMMARY OF THE INVENTION

It is therefore an object of the present invention to provide a device which enables a person to ascend or descend a chain safely.

It is another object of the present invention to provide a chain climbing device incorporating a hand-operated unit and a foot-operated unit.

It is another object of the present invention to provide a chain climbing device in which ascending or descending operations may be accomplished without physical mode changes of the device.

These and other objects are accomplished by a chain climbing device in which a hand-operated upper unit and a foot-operated lower unit are identical except for having handles and foot rests with shoe receiving straps, respectively. The basic chain climbing device includes a pair of opposing cams disposed in a rigid structure which supports a pair of cam pins extending through an elongated aperture in each cam. The weight of the climber is transferred from a pair of cam stops attached to the rigid structure to the cams to a chain link, the cams being shaped to mate with the cam stops and the curved portion of the chain link. The cams are spring closed and automatically engage the chain links. The shape of the cams and the elongated apertures enables the cams to move about the cam pins so that the climbing device be raised, lowered, or locked on a chain link as desired.

Other objects and many of the attendant advantages will be readily appreciated as the subject invention becomes better understood by reference to the following detailed description, when considered in conjunction with the accompanying drawing wherein:

DESCRIPTION OF THE PREFERRED EMBODIMENT

Figure 1:
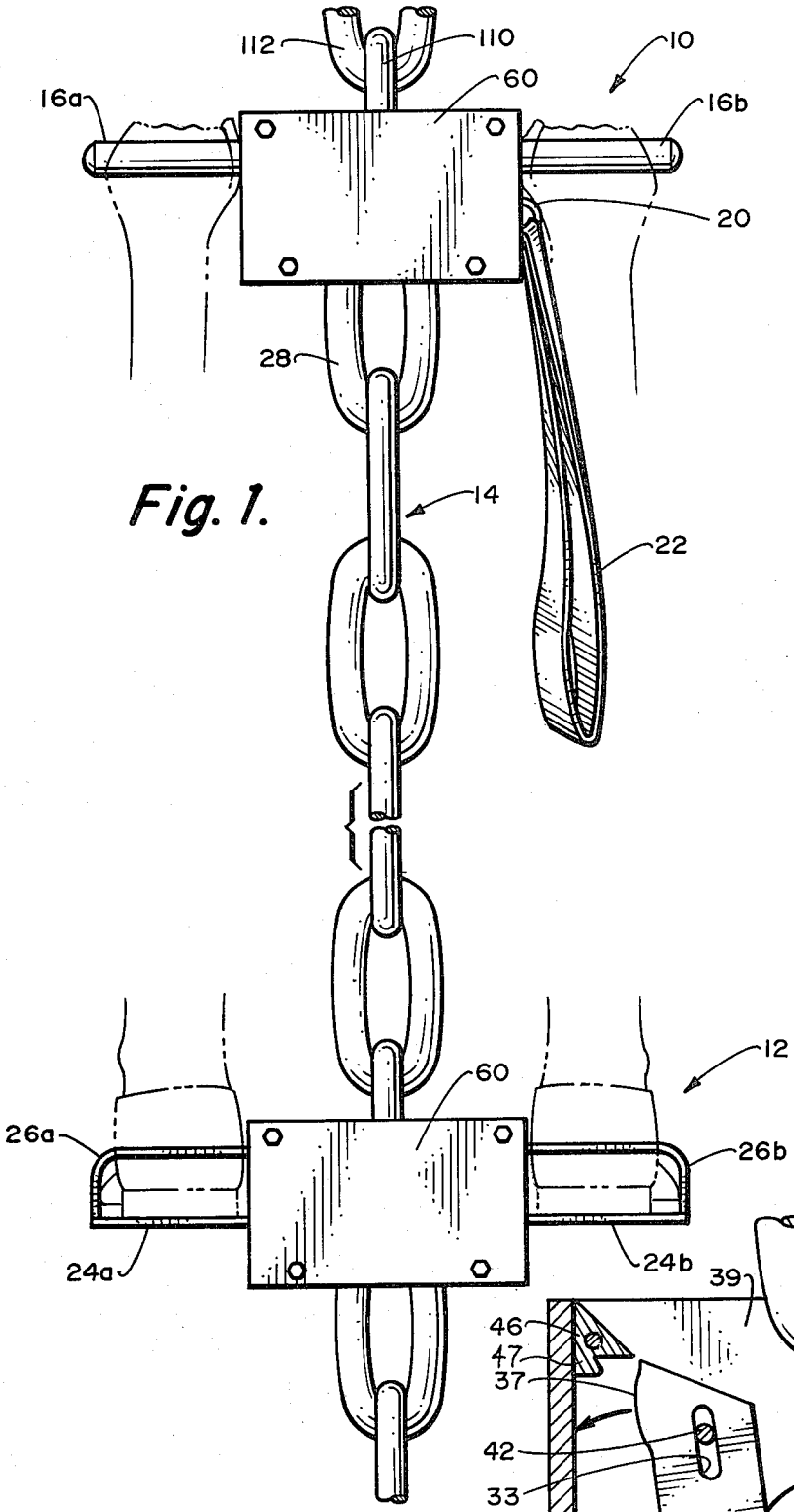
FIG. 1 is a frontal elevation view of the hand-operated upper unit and the foot-operated unit of the personnel chain climber of the present invention applied to a fragment of chain, the chain being broken away intermediate the units.

Referring now to the drawing wherein like reference characters refer to like parts in the several views and, in particular to FIG. 1, the personnel chain climber includes a hand-operated upper unit 10 and a foot-operated lower unit 12 shown engaging a chain 14. The hand-operated upper unit 10 and the foot-operated lower unit 12 are identical in all structure and operation that pertains directly to the chain 14 and differ only in the means for enabling the units for hand or foot operation.

Figure 2:
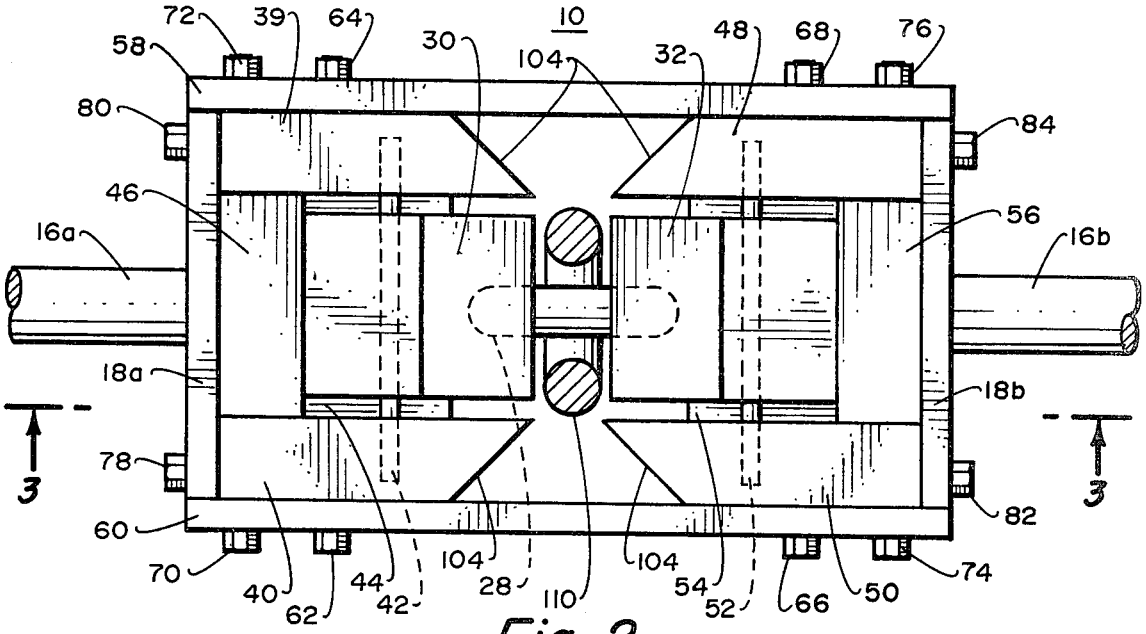
FIG. 2 is a plan view of the hand-operated upper unit engaging a link of chain.

The upper unit 10 therefore includes handles 16*a* and 16*b* adapted for grasping and extending outward from end plates 18*a* and 18*b* (see FIG. 2). End plate 18*b* of the upper unit 10 has an eye 20 for attachment of a safety strap 22 (shown only in FIG. 1). The handles 16*a* and 16*b* and eye 20 may be integral with end plates 18*a* and 18*b* (as shown in FIG. 2) or secured to them by suitable fastening means. The lower unit 12 includes foot rests 24*a* and 24*b* extending outward from end plates 18*a* and 18*b*. The foot rests 24*a* and 24*b* are provided with shoe receiving straps 26*a* and 26*b*. As is the case with the handles 16*a* and 16*b*, the foot rests 24*a* and 24*b* and the shoe receiving straps 26*a* and 26*b* may be integral with the end plates 18*a* and 18*b* or secured to them by suitable fastening means.

Figure 3:
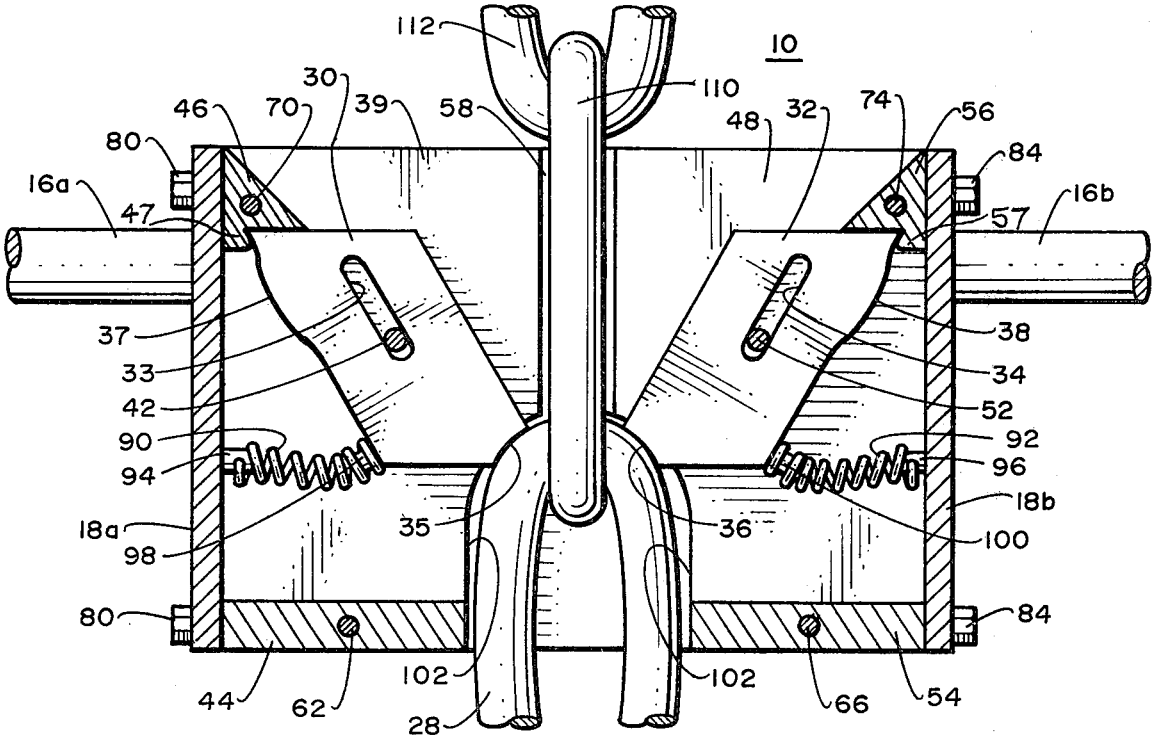
FIG. 3 is a cross-sectional view of the hand-operated upper unit taken along line 3—3 in FIG. 2.

Since the upper unit 10 and the lower unit 12 are identical except for the differences noted in the previous paragraph, the following description of the upper unit 10 is equally applicable to the lower unit 12. Referring now to the plan view of FIG. 2 and the cross-sectional view of FIG. 3, which show the upper unit 10 locked on a line 28 of the chain 14, the upper unit 10 includes a pair of cams 30 and 32, each cam having an elongated aperture 33 and 34, respectively. Each of the cams 30 and 32 has a curved surface 35 and 36, respectively, conforming to the curve of the chain link 28 for mating with the chain as best shown in FIG. 3. Each cam 30 and 32 preferably has a raised surface 37 and 38. Cam 30 is positioned between a first set of cam pin supports 39 and 40. A cam pin 42 (shown in phantom where not visible) having one end mounted in each cam pin support 39 and 40, extends between the first set of supports passing through the elongated aperture 33.

The first set of cam pin supports 39 and 40 are held in a spaced relationship from the cam 30 by a spacer member 44 which extends between the opposing parallel surfaces of the supports 39 and 40 along the bottom thereof. A cam stop 46 extends between the opposing parallel surfaces of the first set of cam pin supports 39 and 40 at the top thereof, abutting the end plate 18*a*. The cam stop 46 has a lower portion 47 shaped to mate with the upper corner of the cam 30.

Cam 32 is disposed in a structure similar to that in which cam 30 is disposed. Cam 32 is positioned between a second set of cam pin supports 48 and 50. A cam pin 52 (shown in phantom where not visible) having one end mounted in each cam pin support 48 and 50 extends between the second set of supports passing through the elongated aperture 34. The second set of pin supports 48 and 50 are held in a spaced relationship from the cam 32 by a spacer member 54 which extends between opposing parallel surfaces of the supports 48 and 50 along the bottom thereof. A cam stop 56 extends between the opposing parallel surfaces of the second set of cam pin supports 48 and 50 at the top thereof and abutting the end plate 18*b*. The cam stop 56 has a lower portion 57 shaped to mate with the upper corner of cam 32.

The first cam pin supports 39 and 40, the second cam pin supports 48 and 50, the cam pins 42 and 52, the cam stops 46 and 56 and spacers 44 and 54 form a rigid assembly, secured between the end plates 18*a* and 18*b* and a pair of side plates 58 and 60 in the following manner. A first bolt 62, passing through apertures in side plate 60, cam pin support 40, spacer 44 and cam pin support 39 and side plate 58 is secured by a nut 64. Similarly a second bolt 66, passing through apertures in side plate 60, cam pin support 50, spacer 54, cam pin support 48, and side plate 58, is secured by a nut 68. A third bolt 70 passes through apertures in side plate 60, pin support 40, cam stop 46, pin support 39, and side plate 58 to be secured with a nut 72. Similarly a fourth bolt 74 is 50, cam stop 56, pin support 48, and side plate 58 to be secured with a nut 76. Two pairs of bolts 78 and 80 secure the end plate 18*a* to the first set of cam pin supports 39 and 40, respectively, the cam supports having a threaded bore for receiving the threaded bolts. Likewise, two pairs of bolts 82 and 84 secure the end plate 18*b* to the second set of cam supports 48 and 50, respectively, the cam supports having a threaded bore for receiving the threaded bolts.

A compressed helical spring 90 is disposed between cam 30 and side wall 18*a*. Similarly a compressed helical spring 92 is disposed between cam 32 and side wall 18*b*. The end plates 18*a* and 18*b* are provided with buttons 94 and 96, respectively, and the cams 30 and 32 are provided with buttons 98 and 100, respectively, for supporting the springs 90 and 92.

In operation, the hand-operated unit 10 and the foot-operated unit 12 of the personnel chain climber may be installed on the chain 14 by removing one side plate disposing the unit about the chain 14 so that the cams may be locked on a link as shown in FIG. 3, and reconnecting the side plate. For example, if nuts 76, 68 and 64 are removed, side plate 58 may be rotated about bolt 70 to permit installation of the climber. The lower, inner surface of each cam pin support 39, 40 and 48, and 50 is curved as shown at 102 in FIG. 3 to allow installation in this manner. Each cam pin support also has a slanted surface 104 as shown in FIG. 2 to facilitate installation.

Figure 4F:
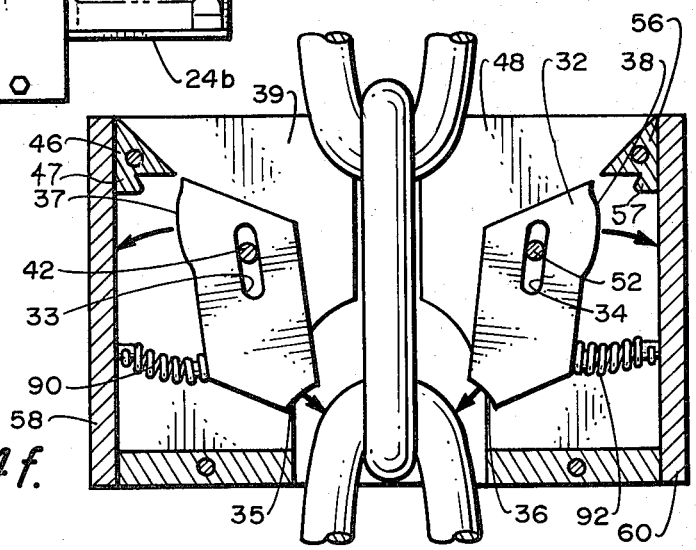
FIGS. 4*a*–4*f* are cross-sectional views illustrating the operation of the personnel chain climber in ascending and descending a chain.
Figure 4A:
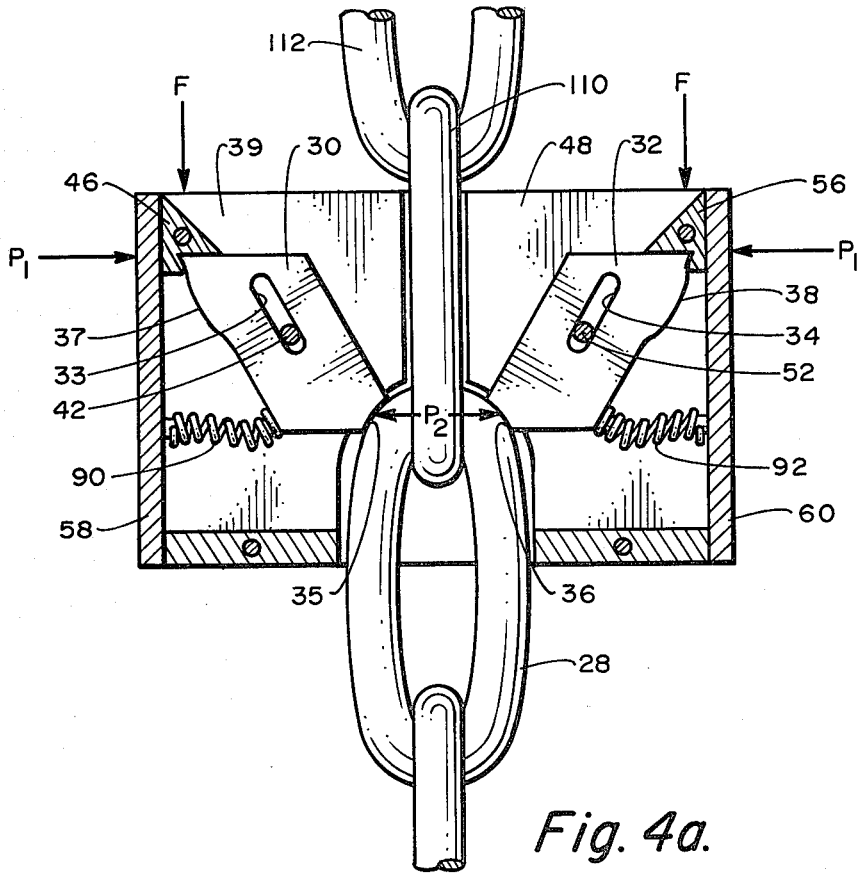
Figure 4B:
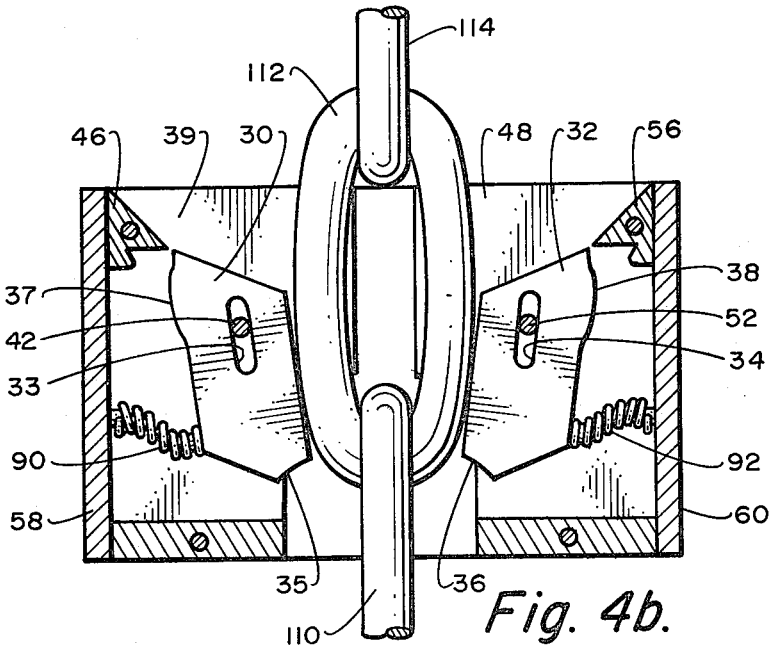

FIG. 4*a* shows the various forces operating when the personnel chain climber 10 is locked on the chain 14 with a vertical load F applied to each handle 16*a* and 16*b*. The cams 30 and 32 are in contact with the cam stops 46 and 56, respectively, and with chain link 28 through curved surfaces 35 and 36. Thrust $P_1$ forces are developed from the side plates 58 and 60 (see FIG. 3) which hold the left assembly (cam 30 and associated elements) and the right assembly (cam 32 and associated elements) together with a tension $\frac{1}{2}$ $P_1$ developed in each plate. The vertical load F from handle 16*a* (or foot rests 24*a* as shown in FIG. 1) is transferred to the end plate 18*a* to the cam stop 46 to the cam 30 to the chain link 28. Similarly the vertical load F from handle 16*b* (or foot rest 24*b*) is transferred to end plate 18*b* to cam stop 56 to cam 32 to the chain link 28. A horizontal force $P_2 (= P_1)$ is developed between the cams 30 and 32 and the chain link 28 through the contact length provided by the curved surfaces 35 and 36, contoured to the chain link. The cam pins 42 and 52 do not experience any load as the vertical loads about the pins and the horizontal loads about the pins are balanced by design.

FIGS. 4*a*–4*e* illustrate the operation of the personnel chain climber in ascending or descending the chain. Starting from the locked position shown in FIG. 4*a*, both the climbing and descending operation are commenced by raising the hand-operated unit 10 or the foot-operated unit 12. Since the end plates 18*a* and 18*b*, cam stops 46 and 56 and cam pins 42 and 52 are a rigid assembly and move together, as unit 10 (or 12) moves by the first link 110 above link 28, the cams 30 and 32 are maintained under cam stops 46 and 56 by the force provided by springs 90 and 92, respectively, about the cam pins.

The upward motion of the unit eventually brings the cams 30 and 32 in contact with the second link 114 above link 28. As the cams 30 and 32 contact the chain link 112, the cams are rotated to assume a position illustrated in FIG. 4*b*. Note that the cams 30 and 32 are not in contact with the top of pins 42 and 52 but are held in place by the force of the springs and the friction between the cams and the chain.

Figure 4C:
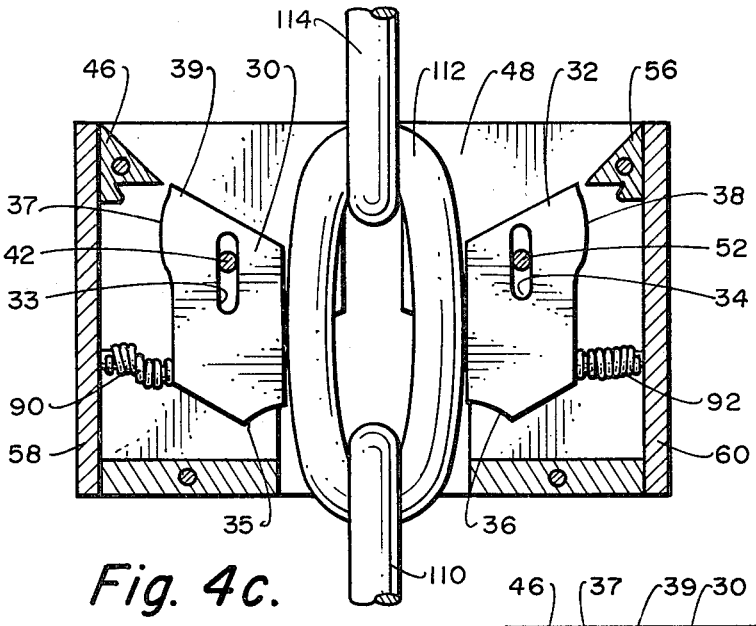
Figure 4D:
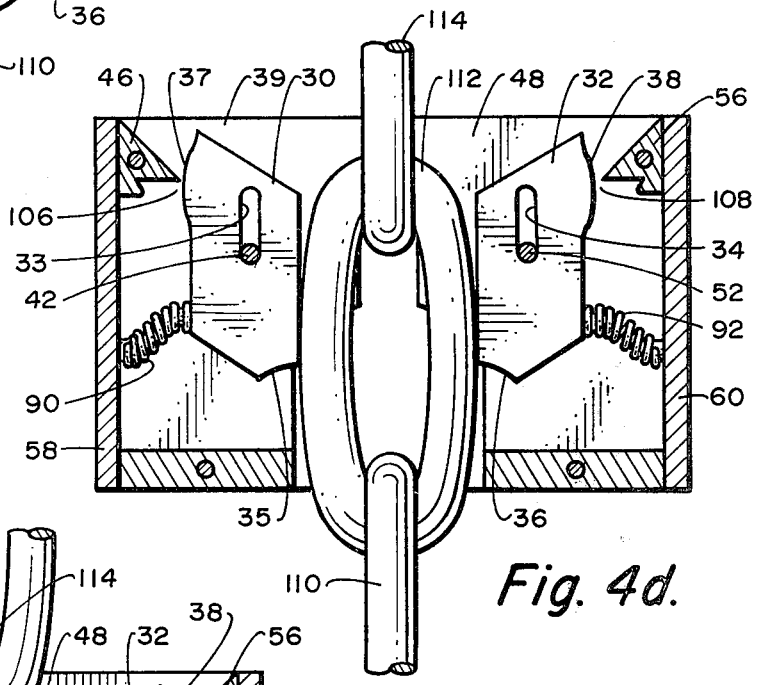

Additional upward movement brings the cams 30 and 32 into the position shown in FIG. 4*c*. The compression force of the springs and the force of the cams bearing on the chain are by design equal, opposite, aligned forces so that there is no moment on the cams 30 and 32. Note that the pins 42 and 52 are not bearing on the cams.

Figure 4E:
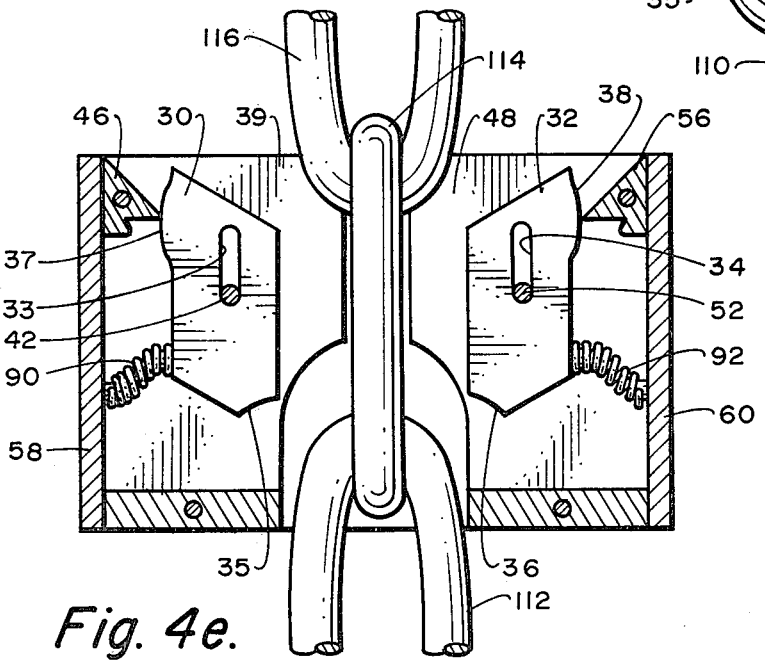

When the chain climber is in the position shown in FIG. 4*c*, either ascending or descending operation may be performed. If climbing is desired, the unit is raised higher toward the top of link 112. As shown in FIG. 4*f*, the cams 30 and 32 will be urged to the locked position on link 112 by the force of springs 90 and 92 as they pass the top of the link 112. The unit 10 may then be lowered to rest on link 112 in the locked position as shown in FIG. 4*a*. If descent is desired, the unit 10 is lowered from the position of FIG. 4*c*. The cams 30 and 32 assume the position shown in FIG. 4*d* with the cams 30 and 32 in contact with the bottom of the pins 42 and 52, but with a gap 106 and 108 between the cams and cam stops. As the unit 10 is lowered to the height of link 110, the springs 90 and 92 rotate the cams so that the raised surfaces 37 and 38 contact the pointed ends of the cam stops while the cams contact the bottom of the cam pins as shown in FIG. 4*e*. The unit 10 may be lowered indefinitely once this position has been accomplished. The unit 10 may be locked on a link by stopping the lowering process and raising the unit until the cams are urged into the locked position, as for example, when the unit is raised so that the cams are slightly higher than the top of a link as in FIG. 4*f*. The unit may then be lowered to the locked position as shown in FIG. 4*a*.

Climbing operations consist of alternate lift and engage movements of the hand-operated unit 10 and the foot-operated unit 12. First the upper unit 10 is lifted up the chain 14 and engaged as shown in FIG. 4*a*. The lower unit 12 is then lifted by the feet and engaged. This process is repeated until the climber reaches the height desired. As the climbing units 10 and 12 move upward with respect to the chain 14, the cams 30 and 32 open (FIG. 4*b*) as each link is passed. Then the climbing units 10 and 12 are lowered with respect to the chain, the cams 30 and 32 are automatically closed by the action of the springs (FIG. 4*f*). The cams 30 and 32 are then locked between the cam stops 46 and 56 and the chain link 28. Forces between the chain, cams, and cam stops, prevent the unit from moving down the chain.

Descending operations likewise consist of alternate repetitious movements. One climbing unit 10 or 12 is lifted such that the cams 30 and 32 are forced open by a chain link as shown in FIG. 4*c*. The unit is then lowered which causes the cams to move upward (relative to the rest of the unit) due to friction forces between the chain link and the cam (as allowed by the elongated aperatures 33 and 34). The upward movement of the cams 30 and 32 causes the cams to assume the relationship of FIG. 4*d* relative to the cam stops 46 and 56. This prevents the cams from engaging the chain as the unit is lowered down the chain. The cams 30 and 32 can be engaged on a link by passing the unit 10 or 12 by a link and then moving the unit upward. This upward movement causes the cams to move downward in the unit and away from the cam stops 46 and 56. The operation of the unit in locking on the link from this point is identical to that of the climbing operation previously described. The cams open as the link is passed; then, the unit is lowered with respect to the chain, the cams are automatically closed by the action of the springs to lock on the link.

It will be recognized that the chain climbing device of the present invention provides a fail-safe method of ascending or descending a chain. In order to disengage a unit from a chain link in such a manner that the unit is free to fall beyond that link, the unit must be raised at least one and one-half links until the cams assume a position on the chain similar to that of FIG. 4*c*. It is inconceivable that this could be accomplished simultaneously with both the hand-operated unit and the foot-operated unit without specifically attempting the simultaneous release and without great effort. Thus, at least one unit will always be engaged on the chain to support the user.

The previous description of the present invention pertains to a chain climbing device in which the chain is fixed and the device is moved relative to the chain. The apparatus of the present invention may also be used as a chain racheting device if the apparatus is held fixed and the chain is moved relative to the apparatus. When used as chain racheting device, the present invention would be oriented up-side-down relative to the orientation shown in FIG. 3; that is, the device of FIG. 3 would be turned 180 degrees so that the cam stops 46 and 56 are at the bottom of the Figure and the spacers 44 and 54 are at the top. With the device 10 secured in this inverted position, the chain may be moved up or down relative to the device or locked in position between the cams 30 and 32 and the cam stops 46 and 56. The operation of the cams in the present invention as a chain racheting device is identical to the operation as a chain climbing device. FIGS. 4*a*–4*f* (inverted) and the accompanying description of cam operation are applicable except that the upward movement of the chain relative to the chain racheting device corresponds to the downward movement of the chain climbing device relative to the chain and downward movement by the chain relative to the chain racheting device corresponds to upward movement of the chain climbing device relative to the chain.

Obviously, many modifications and variations of the present invention are possible in the light of the above teachings. It is therefore to be understood that within the scope of the appended claims the invention may be practiced otherwise than as specifically described.

What is claimed is:

1. Apparatus for use by a person in ascending or descending a chain comprising:

a rigid assembly having a central opening, the chain being disposed through said opening during operation of said apparatus;

a pair of parallel cam pins fixed to said rigid assembly and disposed in said central opening, said pins being on opposite sides of said chain in said opening;

a pair of cams disposed in said assembly on opposite sides of said chain for mating with a link of said chain, each said cam having an elongated aperature through which one of said cam pins is disposed, each said cam being free to rotate about said cam pin and slidable upward and downward on said cam pin as permitted by said elongated aperture;

a pair of resilient means, each resilient means coupled between one of said cams and said rigid assembly for urging said cams inward toward said chain in a direction normal to the direction of said cam pins; and a pair of cam stops fixed to said assembly, each said cam stop projecting inward on opposite sides of said chain into said central opening toward said cam pins for mating with one of said cams when said cams are mated with a link of said chain.

2. Apparatus for use with a chain, said apparatus selectively permitting vertical relative movement between said chain and said apparatus or locking said chain and said apparatus in a fixed relationship comprising:

a rigid assembly having a central opening, the chain being disposed through said opening during operation of said apparatus;

a pair of parallel cam pins fixed to said rigid assembly and disposed in said central opening, said pins being on opposite sides of said chain in said opening;

a pair of cams disposed in said assembly on opposite sides of said chain for mating with a link of said chain, each said cam having an elongated aperture through which one of said cam pins is disposed, each said cam being free to rotate about said cam pin and slidable upward and downward on said cam pin as permitted by said elongated aperture;

a pair of resilient means, each resilient means coupled between one of said cams and said rigid assembly for urging said cams inward toward said chain in a direction normal to the direction of said cam pins; and a pair of cam stops fixed to said assembly, each said cam stop projecting inward on opposite sides of said chain into said central opening toward said cam pins for mating with one of said cams when said cams are mated with a link of said chain.

3. Apparatus as recited in claims 1 or 2 wherein each said cam has a curved surface contoured for mating with curved portion of said chain link.

4. Apparatus as recited in claims 1 or 2 wherein each said resilient means is a helical spring.

5. Apparatus as recited in claims 1 or 2 wherein said cams and said cam stops have complementary surfaces for mating when said cams are mated with the curved portion of said link of chain.

6. Apparatus as recited in claims 1 or 2 further comprising means fixed to said assembly for raising or lowering said apparatus relative to said chain.

7. Apparatus as recited in claim 6 wherein said means for raising or lowering includes handles attached to said assembly.

8. Apparatus as recited in claim 6 wherein said means for raising or lowering includes a foot rest provided with shoe receiving straps.

9. Apparatus for use with a chain, said apparatus selectively permitting vertical relative movement between said chain and said apparatus or locking said chain and said apparatus in a fixed relationship comprising:

a first cam having a curved surface contoured for mating with a curved portion of a chain link and having an elongated aperture;

a first cam pin passing through the elongated aperture of said first cam;

means for supporting said first cam pin including a first pair of cam pin supports, each support disposed for supporting an end of the first cam pin;

a first cam stop disposed between said first pair of cam pin supports;

a second cam having a curved surface contoured for mating with the curved portion of a chain link and having an elongated aperture;

a second cam pin passing through the elongated aperture of said second cam;

means for supporting said second cam pin including a second pair of cam pin supports, each support disposed for supporting an end of said second cam pin;

a second cam stop disposed between said second pair of cam pin supports;

means for joining said first and second cam pins, said means for supporting said first cam pin, said means for supporting said second cam pin, and said first and second cam stops to form a rigid structure having a central opening in which said first and second cams are disposed in opposing relationship and through which the chain passes;

first resilient means coupled between said first cam and said rigid structure to urge said first cam away from said rigid structure in a direction normal to the direction of said first cam pin; and second resilient means coupled between said second cam and said rigid structure to urge said second cam away from said rigid structure in a direction normal to the direction of said second cam pin.

10. Apparatus as recited in claim 9 wherein each said resilient means is a helical spring.

11. Apparatus as recited in claim 9 further comprising means fixed to said assembly for raising or lowering said apparatus relative to said chain.

* * * * *